US008378191B2

(12) United States Patent
Barillaro

(10) Patent No.: US 8,378,191 B2
(45) Date of Patent: Feb. 19, 2013

(54) SOUNDBOARD BRACING STRUCTURE SYSTEM FOR MUSICAL STRINGED INSTRUMENTS

(76) Inventor: Joseph Barillaro, Palmwoods (AU)

( * ) Notice: Subject to any disclaimer, the term of this patent is extended or adjusted under 35 U.S.C. 154(b) by 0 days.

(21) Appl. No.: 13/379,057

(22) PCT Filed: Jun. 25, 2009

(86) PCT No.: PCT/AU2009/000822

§ 371 (c)(1),
(2), (4) Date: Dec. 19, 2011

(87) PCT Pub. No.: WO2010/148420

PCT Pub. Date: Dec. 29, 2010

(65) Prior Publication Data

US 2012/0097007 A1 Apr. 26, 2012

(51) Int. Cl.
*G10D 1/08* (2006.01)

(52) U.S. Cl. ..... 84/267; 84/291

(58) Field of Classification Search ..... 84/267, 84/290, 291, 293, 294

See application file for complete search history.

(56) References Cited

U.S. PATENT DOCUMENTS 7,164,072 B2 * 1/2007 Park ..... 84/294

* cited by examiner

*Primary Examiner* — Kimberly Lockett

(57) ABSTRACT

A bracing structure formed onto the underside soundboard surface of an acoustic musical stringed instrument comprising two bracing bars (1, 2) that are used to support the soundboard and bridge in an indirect fashion from strings directional load tension via a realignment of the strings directional load tension placed through adjoining triangular blocks (3, 4), which re-alignment of the strings directional load tension is taken at acute angles to the line of the strings and focused on a predetermined point found on the bars (1, 2) that are also placed away and at an acute angle to the line of the strings, the acute angling allowing for string vibrations to be largely diverted away from an otherwise direct load line and redirected into the soundboard via a thin half circular shaped block (5) and through several fine bar braces (10, 11, 12, 13, 14, 15, 16, 17, 18, 19, 20, 21, 22, 23, 24) arranged in a somewhat spoke like pattern.

11 Claims, 5 Drawing Sheets

SOUNDBOARD BRACING STRUCTURE SYSTEM FOR MUSICAL STRINGED INSTRUMENTS

BACKGROUND

1. Technical Field of the Invention

This invention relates to acoustic musical stringed instruments and more particularly to a novel soundboard bracing structure system for improving the quality of the musical sound that is produced by such instruments.

2. Description of Prior Art

Musical stringed instruments such as acoustic—steel or nylon stringed guitars, lutes and the like are typically comprised of a neck attached to a hollow body. The body usually consists of a top face, termed the sound board, to which side walls are formed and attached around its perimeter, the side walls also attach to a backboard, enclosing an air filled chamber. The air filled chamber also referred to as a resonator, can vary in size, shape or form. Traditionally constructed from different timber species but also in recent times using modern materials such as polyester glass reinforced resin or even carbon composites.

The soundboard usually has one or more openings referred to as a "soundhole", which can vary in shape and location. A bridge structure is engaged to the soundboard and made large enough to attach a plurality of strings to. The bridge structure can simply be rectangular or some other shaped piece of hard timber or made from other suitable materials. The strings connected to the bridge pass over but make firm contact on to a thin strip of hard material such as bone or brass which is recessed into the bridge and is usually referred to as the bridge "saddle"

The strings continue over the saddle and are stretched to the end of the neck where they pass over but make firm contact onto a notched thick strip of hard material, referred to as a "nut" which is fixed to the neck end of the instrument. The strings are then secured to turn able pegs or machine tuners fixed to a "head" plate at the free end of the neck. The pegs or tuners are used to individually tension the strings to a predetermined pitch producing certain musical notes of frequencies when struck or plucked.

Where vibrating strings make contact with the recessed bridge saddle is where the vibrations of the strings pass through into the soundboard. Sound is generally a wave disturbance of air. The amount of air that can be disturbed by the surface area of a vibrating string alone is fairly negligible compared to the vibrating surface area of the soundboard. Ideally the entire soundboard will vibrate in unison with the vibrating string(s) causing the air inside the hollow body to wave, reflect and to essentially resonate and emanate through the sound hole. Thus amplification of the vibrating string(s) is achieved.

The above is a general simplification in the workings of acoustic musical stringed instruments. In fact there are many factors; forces, parameters, material characteristics to consider.

A close examination of musical stringed instruments shows that the soundboards are generally extremely thin compared to their surface area's and usually made from a soft timber such as spruce or pine. Such soundboards are able to vibrate more freely or vigorously than thicker ones and therefore are able to displace greater volumes of air within the hollow body, essentially producing greater amplification of sound.

Unfortunately the soundboards are not self-supporting and their resistive capabilities towards the tensional forces of the strings are minimal. Hence traditional and modern acoustic musical stringed instruments have braces glued to the underside of the soundboard. There have been many designs and patterns devised trying to produce the best possible outcome in sound-volume and tonal qualities. Designers have tried to use bracing systems to not only support the soundboard but also to spread the vibrations throughout the surface area of the soundboard. For guitars with six strings there are two bracing systems currently used as an industry standard and each may vary slightly from one guitar manufacturer to another. One is an "X" bracing system developed by C.F. Martin & Company in the mid nineteen hundreds and mainly used for larger steel stringed guitars such as the dreadnought; to which the shape and size is also attributed to C.F. Martin & Company. The other is a "FAN" bracing system largely used for smaller body gut or nylon stringed guitars that was developed by Antonio Torres in the mid eighteen hundreds. He is also acclaimed to have designed the present shape and size of the modern "Spanish classical guitar" body.

Soundboard with "X" bracing systems have shortcomings that are deflections and deformities by way of compression and bulging. On observation it can be seen that the area front of the bridge becomes compressed down while the area behind the bridge and extending towards the end block bulges upwardly. Deflections also occur in the areas halfway along the four arms of the "X" bracing, to where smaller braces are often fixed to the soundboard. Further deflection can also be found at the ends of the "X" bracing arms at these points the deflections cannot be noticed visually. The important thing to note is that the side-walls of the body take up some of the string load tension and more importantly the soundboard is placed under stress and is not able to vibrate uniformly due to all the summed up deflections which have been caused by the lack of direct support for the directional load tension of the strings.

"FAN" bracing systems are usually found in nylon stringed classical Spanish type guitars. Fan bracing normally comprises of a substantial brace glued under the soundboard, just below the soundhole and perpendicular to the line of the strings. Effectively the larger portion of the soundboard, from the waists of the body down to the end-block of the body is isolated from the upper part. In the larger portion of the soundboard, several long thin bracing bars are arranged in a fan like pattern generally in the same direction as to the strings and fixed to the underside soundboard surface. A long rectangular bridge glued to the top of the soundboard lies somewhat central and perpendicular to the fan-bracing pattern. The whole function of the fan-bracing pattern is to spread out the vibrations into the soundboard that are coming from the bridge. Even though this type of guitar normally exhibits only about half of the string tension that is found on steel stringed guitars, the same sorts of problems that are found on the "X" bracing system are also apparent in the "FAN" bracing system. Deflections of the soundboard can be noticed in the upper body area, above the main brace and to a greater extent in front and behind the bridge areas of the lower part of the body. All of the deflections and deformities are due to the lack of direct support for the strings directional load tension, exerted onto the soundboard via the bridge.

The "X" and "FAN" bracing systems being used by guitar manufacturers today all tend to restrict the uniform vibrating motion of the soundboard, as discussed above. The main reasons for using these said bracing systems, is so that the soundboard is not overly stiffened, thus allowing the string(s) to vibrate the soundboard strongly.

The strings under load tension exert a force at their two fixed end points, with one end attached to the bridge of the soundboard and the other end attached to the head plate of the neck. In part a rotational torque force is also potentially exerted onto the nodal points being the nut and saddle. The available transmissions of the vibrating string energy that is directed into the soundboard occurs at the nodal point source of the saddle, but the strings vibrating duration period is largely governed by the support structure that holds the strings. The continuation (sustain) of the vibrating string(s) can only occur, if the string(s) are held by a ridged support structure.

However using a ridged support structure to allow for a prolonged string sustain period; and thereby also alleviating the soundboard from the tensional forces of the strings so that it can also vibrate uniformly; is not a new concept nor is it easily achievable. All past attempts have adversely affected the instruments tonal qualities and reduced the transmissions of the vibrating strings, into the soundboard.

In fact many bracing patents have been proposed to address the problem. As far back as the early nineteen hundreds, patents have been submitted where the entire neck is extended through the hollow body and firmly fixed to the end-block of the body, as may be seen in US patents such as; U.S. Pat. Nos. 1,754,263; 1,426,852; 1,889,408; 2,793,556 and more recently U.S. Pat. No. 5,679,910. Some models incorporated a solid beam, or one or two steel rod(s) fixed 125 between the neck heal-block and the end-block of the body, with a screw-out jack in the middle of the rod(s) or at the end-block location; in an effort to pre-tension and thereby relieve the soundboard, from the tensional forces of the strings.

The use of through rod type systems puts stress on the soundboard. Central flexing of the rods occurs and is at odds with the vibrating soundboard, putting the soundboard under a damping effect, due to opposing tensions. This damping effect cuts short the natural harmonic frequencies produced by the strings and therefore buffers the natural qualities of the sound.

Other attempts to support the string tension by locating the through body neck-beam-section closer to the soundboard still have the same problems, even when longitudinal and transverse bracing has been used under the soundboard.

Other patents like U.S. Pat. No. 5,025,695 propose that a through body neck beam be glued to the soundboard and have it ending at the bridge area. This requires the soundhole to be located away from the line of the neck. Alternatively the paten proposes to simply affix two or more brace bar supports by gluing them directly under the sound board, where the through body neck beam would normally come through and also ending at the bridge area. Alternatively the through body neck beam is clear of the soundboard but ending at and glued to an area under the bridge.

Consequently most of the strings vibrations are upheld within the strings and in part transmitted into the ridged support structure upholding the strings tension, rather than diverting it into the soundboard, were it would be most useful.

It's clear that vibrating string energy is not easily transmitted into the soundboard, whilst trying to support the tensional forces of the string(s), using the above bracing structures and or bracing pattern systems discussed.

It's also clear that the soundboard is not able to vibrate uniformly due to unwanted soundboard deflections. Since whether the deflected areas are large small or differ in magnitude, they are areas under stress or strain and because of this fact, they will resist and deform the oncoming vibrations through the soundboard.

The soundboard can be considered to be a thin membrane. The unified motion of a thin membrane is one in which the central area of the membrane waves up and down (perpendicular to its surface area), traveling at an equal distance from its central position in every direction outwardly towards its perimeter. In doing so the membrane also displaces the air above it and below it uniformly, propagating air-sound waves in the truest possible form, but only if it is in a stress free state to begin with.

3. A General Description for the Content of Musical Tones or Notes.

The structure of musical tones or notes is a known science that explains the behavior of sound waves to create a harmonious sound.

Generally a musical note produced by a vibrating string is made up of several pure sine wave harmonics, along with its fundamental sine wave frequency, (f1). Basically the harmonics are multiples of the fundamental i.e. 2×f1, 3×f1, 4×f1 etc, increasing in frequency but unfortunately decreasing rapidly in amplitude (sound level).

The first few harmonics produced are what makes the musical note sound musical, the more these harmonics can be heard, the richer and fuller the sound becomes.

An acoustic musical stringed instrument that can produce high values of acoustic sound intensity (volume amplitude) has a desirable quality, but the sound intensity of the harmonics that are produced by the action of the vibrating strings are generally of greater importance to the musical notes, as can be seen from the above statement.

When playing several notes of a melody, the duration of a musical note within the melody may also need to be sustained. With a rapid loss in harmonic sound levels this is not easily achievable. The musical note can be dramatically reduced to what is commonly referred to as a "dead note".

The musician can struggle with the dead note by using a technique called vibrato, where the string is depressed harder and vibrated more so by the rocking motion of the finger. This vibrato action produces more of a wavering sound, rather than a long lasting continuous sound which is more correctly the sustain that's wanted.

From the above information it's understood that while a high value of acoustic sound intensity is desirable, the sound intensity of the harmonics along with sustained harmonic sound levels is more important to the content and production of musical notes.

Without sustain of sound volume levels and the presence of high sound volume levels for the harmonic content of musical notes, the quality factor of a full rich sound is not produced.

To produce an equal sustain period within a range of strings, say for the six strings of a commonly produced guitar today, is not achievable.

When we consider the unit per length of mass weight, is greatly different from a bass string to a treble string. It is this mass weight of the individual string that governs how long a period it will vibrate for. With all six strings held by the same support structure, typically the bass strings will sustain longer than the treble strings.

Putting initial volume levels aside, the restricted condition of sustain between the individual strings of the range of strings fortunately does not have to be a huge problem. When its considered that an individual note produced by a high frequency treble string, would not normally need to be sustained for more than a full note period in the passage of a 4/4 bar in the musical score. Just the same though, even sustain of this short period of time would rarely be found in the high treble range of industry standard guitars produced today.

Collectively several musical notes sounded together from a plurality of strings must also have equal sound levels (be balanced). This is so they do not mask or obscure each other's musical potential.

The features describing "string range balance" are: initial equal sound levels between all strings, a period of sustained sound levels that is manageable between strings and clear clean sound with harmonic content for all musical tones or notes. An acoustic musical stringed instrument with these qualities could be described as, a well-balanced instrument.

For example a six stringed guitar typically produced today having a bass to treble range extending 3 octaves, have a loud ringing bass with diminished trebles so their string range is musically restricted.

Today a musician is able to choose an acoustic musical stringed instrument such as a guitar produced by large industry manufactures. The musicians will trial the instruments empirically with a view simply tending towards a mellow tone, warm tone or a bright tone.

Different species of timbers used for the soundboard are able to produce various tones by their own characteristics and will influence the musician's choice, such as the warm tones produced by cedar and the bright tones produced by spruce.

The nylon or gut strings of a classical guitar will produce a mellow tone, and in conjunction with either a cedar or spruce soundboard will have a warmer or brighter mellow tone.

Looking for other more important qualities such as a well-balanced string range response; the musician invariably will then experiment with a large assortment of strings made from different materials and thereby producing differing tonal qualities, and according to the string(s) diameter or density will also produce varying periods of sustain when vibrated. Usually the experiments result into an unacceptable or restricted outcome.

In my business over the past thirty years of repairing and servicing acoustic musical stringed Instruments I have often heard musicians complaining about the "string range balance", using remarks such as; "sounds too tin-y, no middle, overly bass-y, no sustain, lots of dead notes, not clean, dirty" or "muddy and cloudy".

The novel bracing structure system of the invention that I will be describing to follow enhances the playing experience for the musician and listener alike, as the above problems are substantially alleviated.

OBJECTS OF THE INVENTION

With the foregoing BACKGROUND points 1, 2 and 3 in mind, a primary object of the invention is to provide a workable soundboard bracing structure system for acoustic guitars, lutes and the like, that has a close alignment to the directional string length; and thereby can also be made to withstand the predetermined string length tension, in order to allow for vibrating string length sustain.

A secondary objective of the invention is that the primary object is also able and strong enough to alleviate substantially, unwanted deflections of the soundboard, thereby allowing the soundboard to have uniform motion, that's true to its source.

A third objective of the invention is that the primary object does not act to resist or capture vibrating string energy without being able to release it, but rather acts more so in a predictable and controlled manner to transmit as an output source the vibrating string energy, from its main primary object bracing structure into the soundboard.

A fourth objective of the invention is that the primary object is also able; along with using other object bracing means, to further distribute the available vibrating string energy throughout the soundboard surface area, said other bracing object means also thereby allowing for a well-balanced string range response from the soundboard; and along with also providing further object bracing means utilized for producing clear clean rich full musical notes.

SUMMARY OF THE INVENTION

In accordance with the aforementioned objects above, the present invention provides a bracing system structure formed onto the underside soundboard surface of an acoustic musical stringed instrument such as for acoustic guitars, lutes and the like having a low frequency bass to a high frequency treble string range group. The vibrating string(s) energy is transmitted through its (or their) bridge saddle nodal point(s) and through the soundboard into the bracing structure means as follows.

The bracing structure uses a novel standoff approach; in relation to the directional line of the vibrating strings reflective elastic energy, occurring between their two nodal ends, whereby a third point of reflection is taken at an acute angle uniquely away and apart from the string line; by way of the following bracing structure parts fixed to the underside timber soundboard surface.

Two triangular blocks (herein also referred to as "LMBD-blocks") are used; each with one of their sides positioned in alignment to and directly below the bridge saddle and each with one of their other sides fixed and butted up to one of two longitudinal bar braces. The two longitudinal bar braces (herein also referred to as "indirect-bar" braces) are positioned with each of one of their ends located below either side of the bridge saddle, and to the outside of the string range group span located above, their lengths extend indirectly at an acute angle away from the line of the outermost strings; and where the instrument has a sound hole under the string range group span, running either side of this sound hole continuing above the sound hole with both other ends interconnected to a commonly used transverse brace. The two longitudinal bar braces in combination with the two triangular blocks also serve to support and alleviate substantially unwanted deflections of the soundboard, by upholding the directional predetermined string-length tensions (herein also referred to as "PST").

The functions of the triangular blocks are: to firstly load the PST from the attached string range group at the bridge on to the longitudinal bar braces at acute angles to the string lengths, this happens at an acute angle because the two triangular blocks are apart from one another and are largely only supported by the indirect-bar braces; the points (herein also referred to as "points-A") to where the PST is redirected and loaded on to the indirect-bar braces is to where the PST can be upheld or loaded without failing, these points-A are found basically where the triangular blocks run-out on to the indirect-bar braces and are also the aforementioned third points of reflection taken away and apart from the string line; the indirect-bar braces themselves are also at an opposing obtuse angle to the redirected PST load line. Other functions of the LMBD-blocks are: secondly, the available acoustic energy from two or more vibrating strings will follow the same redirected load lines of PST and in doing so are mixed and concentrated into points-A; thirdly, they serve to buffer inactive strings from being sympathetically vibrated, due to their large mass, allowing for clear clean notes; fourthly, they act to divide and separate the bass string range from the treble string range, by being placed individually there under, effectively creating a separate response for the bass or treble side of the soundboard.

Points-A are normalized close to the ends (theses "ends" herein also referred to as "points-B") of the indirect-bar braces interconnecting with the transverse brace. From where the indirect-bar braces interconnect with the transverse brace (points-B) they are well supported, by two blocks (herein also referred to as "reflection-blocks") adjoining to the above opposite side of the transverse brace and also butt up to a commonly used fingerboard support block. The reflection-blocks serve to efficiently reflect acoustic pressure waves by their large mass, from points-B back through the indirect-bar braces to their opposite ends (theses "ends" herein also referred to as "points-C") and to the adjoining triangular blocks; where all these bracing parts form a straight line side directly under the bridge saddle and to which a half circular shaped bracing member (herein also referred to as a "transmitting-lobe") is fixed to. Where then the acoustic pressure waves are distributed throughout the soundboard surface area; since from this location there is no direct support to the PST; firstly by the transmitting-lobe, secondly by the use of long fine bracing bars attached to the transmitting-lobe and extending outwardly in a spoke like pattern towards the near end perimeter of the soundboard, (herein also referred to as "transmitting-bars"). The directional positioning of the transmitting bars towards the perimeter of the soundboard allows for a well balanced string-range response, in regards 330 to sound-levels between the strings and sustain thereof.

The foregoing and other objects, features and advantages of the invention will be more clearly understood by the following detailed description or best mode of preferred embodiments of the invention as illustrated with the accompanying drawings.

BRIEF DESCRIPTION OF THE DRAWINGS

FIG. 1 is a perspective view of the first guitar example having a large body with steel strings, and to which the bracing structure system of the invention may be applied to.

FIG. 2 is a perspective view of the second guitar example having a small body with nylon strings, and to which the bracing structure system of the invention may be applied to.

DETAILED DESCRIPTION AND OR BEST MODE OF THE INVENTION

While the novel objects, features and advantages, of the inventions well-balanced bracing system structure may be applied to the soundboards of more than one type of an acoustic musical stringed instrument, in order to illustrate and clarify the workings thereof, two examples of an acoustic guitar is used herein.

Where references to drawings will be made to clarify the method of operations for the embodiments of the guitar examples; but it is to be expressly understood, that the drawings are for the purpose of illustration and description only and are not intended to express the limits of the invention.

Figure 1:
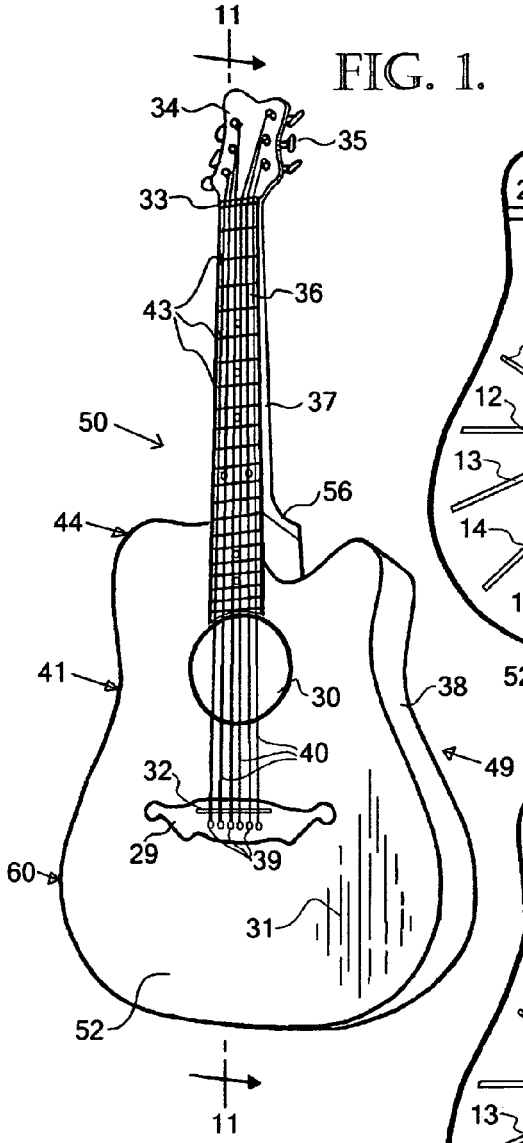

Referring now to FIG. 1, a perspective view of the first guitar examples 50 is of a large body 49 steel stringed acoustic guitar constructed from timber in which the bracing structure system of the invention may be applied to, is shown. The guitar has a hollow body 49 with a waist 41 between curved upper bout 44 and curved bottom bout 60 giving shape to the soundboard 52 that's attached to side walls 38 of which are also attached to a backboard not shown enclosing an air filled chamber. A neck 37 from its heel 56 extends 400 outwardly from the hollow body 49, with its free end having a head plate 34, to which turn able pegs or tuning machines 35 are fitted to, and are used to tension the attached string range group of six strings 40.

The fingerboard 36 which has numerous fixed frets 43 is adhered to the neck 37 and soundboard 52. The soundboard 52 has a soundhole 30 through it and has a fixed bridge 29 housing a saddle 32, located below the soundhole. The string range group 40 having ball ends 53 are inserted into bridge pin holes 57, and are firmly fixed by the insertion of bridge pins 39. The anchored strings 40 are taken up at an angle from the bridge 29 surface making firm contact with the bridge saddle 32 as may be seen in FIG. 11. The strings 40 then extend along the fingerboard 36 of the neck 37 passing over and making firm contact with the nut 33 are attached to tuning machines 35, which are used to tension the strings 40 to a predetermined pitch. The string range group of six strings 40. have string diameters approximately 1.35 mm to 0.3 mm respectively able to produce low-bass to high-treble frequencies, and also respectively arranged from the left side of FIG. 1 to the right side of FIG. 1.

Figure 2:
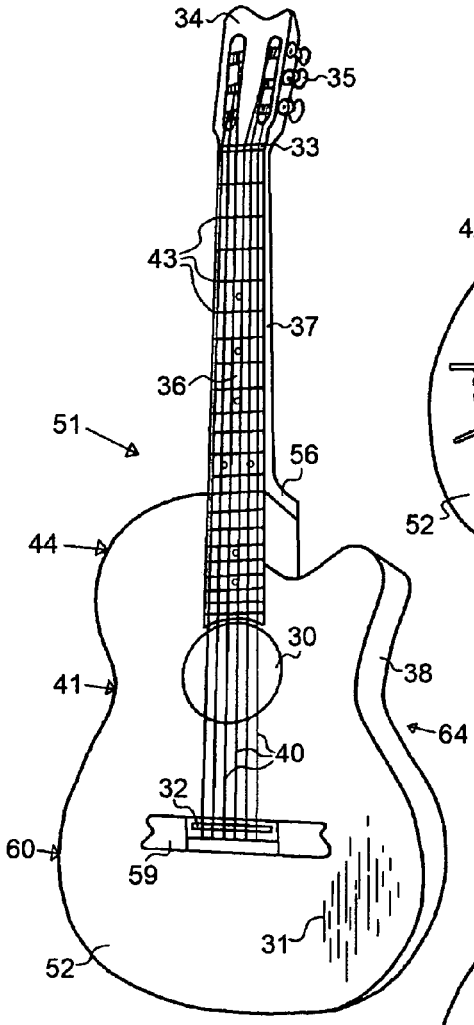

Referring now to FIG. 2, a perspective view of the second guitar example 51, generally described by and showing the same designated character reference numbers as seen in the first guitar example 50 of FIG. 1, except for the different bridge 59 to which the strings 40 are instead tied to, is of a Spanish classical style, smaller body 64 and constructed from timber with nylon or gut strings; with its bass to treble string range group diameters being: 1.12, 0.91, 0.76, 1.04, 0.83, 0.73 and arranged in the same sequence as for the first steel stringed guitar example 50. The distance across the six strings for both guitar examples at the bridge saddle 32 will be referred to as the "string range group span" 63 as may be seen in FIG. 3.

Acoustic Guitar Analysis

In order to clarify the workings of the invention some transparency is needed for which the following is a short acoustics process analysis for the guitar examples' 50 and 51. In the analysis, outlining the workings and desirable outcomes of different stages, produces certain technical concepts or objects and therefore contains terms which may be constantly referred to in the detailed description and or the best mode of the invention. In order to simplify for novel bracing members acronyms are used for certain objects of the invention and more specifically for certain known physical states of energy or forces, an acronym may follow immediately after the described or said physical energy or force, in brackets, after which the acronym only may appear within the discussion.

The string range group lengths of the six strings 40 are stretched to a predetermined tension by use of the tuning machines 35, the predetermined string tension, which herein is also referred to as PST and has herein been aforementioned, places a static load tension 440 (force) of approximately 730 Newtons (N) between the fixing points of the strings, for the steel stringed guitar example 50 and 390 N for the nylon stringed guitar example 51. Along the entire length of each string the PST is static, and but with components of rotational torque (RT) forces, namely between the saddle 32 and the ball end 53 of the string, and between the nut 33 to the tuning machines 35 of the string. The RT components are due to the angles made by the strings, as may be seen in FIG. 11 and FIG. 1.

Each of the strings 40 playable string length is defined by the distance made by each string between the nodal point of the nut 33 and the nodal point of the saddle 32, firmly 450 held by the two RT components, of the string.

Basically the wanted musical sound that is produced by the guitar examples 50 and 51 is created in four separate stages making up a whole system. Each stage can be considered to be a system of its own, but each stage also needs to be processed into the next stage with the output to input having not only maximum power transfer but also stability.

Starting with the process of the First Stage, the vibrating strings 40 are made to vibrate simply by the input motion of the musician's hand. Essentially a vibrating string 40 disperses elastic energy (EE) in and around its predetermined string tension (PST) state, causing its string length nodal points of the nut 33 and the saddle 32 to potentially vibrate with acoustic pressure waves (APW). The nodal points of the string are the output potential sources for the first stage. Obviously the nodal point of the nut 33 for a string 40 is held rigid by the solid structure of the neck 37, vibrating to a far lesser degree than the nodal point of the saddle 32. Each nodal point of the saddle 32 for each string has the greatest potential output of APW energy (APWE), available central to the soundboard 52. The support bracing structure system for the vibrating strings 40 is the Second Stage; it has three process functions to deal with. The first function is that it should be made strong enough to withstand the PST, thereby allowing for sustain of the vibrating strings 40. Its second function is to divert the APW coming through the nodal saddle 32 points away from the direct alignment of the strings, and reflect the APW from the main support bracing structure system only into the soundboard 52. The third function is that it should also be made strong enough to alleviate virtually all of the stress that the soundboard 52 is under by the PST force, thereby allowing the soundboard 52 to vibrate freely and uniformly.

The Third Stage is the soundboard 52 in motion. If the processing of the first and second stages has allowed for maximum power transfer—with stability, then the third stage, the soundboard 52 in motion is able to vibrate with uniform motion. Therefore also able to produce a faithful amplified representation of the strings vibrating frequencies, with clear clean volume displacement amplitudes of airwaves into the Fourth Stage, being the hollow body 49 or 64 of the guitar examples 50 or 51 respectively. Where the air waves then reflect within, essentially resonate and emanate through the sound hole 30.

The above process Acoustic Guitar Analysis shows Second Stage to be a major controlling part of the four-stage system and it is in this stage predominately that the invention relates to, being the support bracing structure system.

The above Acoustic Guitar Analysis will now also be used in reference with all of the following detailed description of the invention and in conjunction with the drawings. In looking at the first function of the Second Stage, the strings 40 vibrating duration period, sustain, can only occur by withstanding the static PST of the strings. The PST force aforementioned for the steel stringed guitar 50 of FIG. 1, has 730 N exerted onto its soundboard 52 of its body 49 and neck 37, this force can be equated to having a weighted mass of 75 kilo grams (kg); while the nylon stringed guitar 51 of FIG. 2, having a force of 390 N, exerted onto its soundboard 52 of its body 64 and neck 37, can be due to having a weighted mass of 40 kg.

Figure 3:
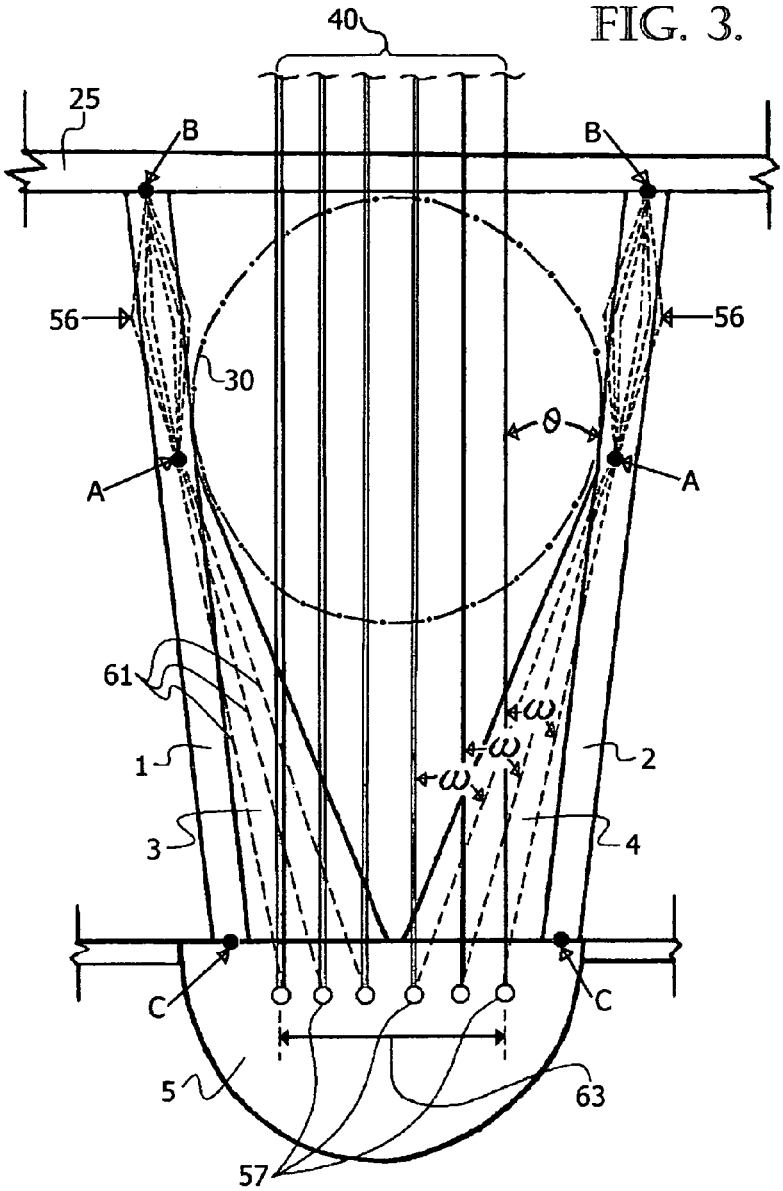
FIG. 3 is an exposed partial plan view with the soundboard removed and shows bracing bars or members with detail to the perceived string load forces, central to the inventions main bracing structure system for any one of the embodiments; with other bracing members of the invention omitted in order to simplify.

Referring now to FIG. 3, an exposed partial plan view with the soundboard 52 removed, showing bracing bars and parts or members central and critical to the inventions main 500 bracing system structure, with other bracing of the invention omitted in order to simplify. The dot-dash circular line shows where the soundhole 30 would normally be.

Two longitudinal bar braces 1 and 2, as may also be seen on the opposite underside soundboard 52 view of FIGS. 6, 7, 8, and 9, and from hereafter may be referred to as indirect-bar braces 1 and or 2 as aforementioned elsewhere, are used and need to be made strong enough to withstand the PST force aforementioned. Since indirect-bar braces 1 and 2 lie nearly parallel to the plane and also generally run in the same direction to the string range group 40 lengths, they do not need to be made very large to withstand the PST force aforementioned.

Investigating the processing of the second function shows an immediate apparent obstacle, if the indirect-bar braces 1 and 2 were to be placed within the area of the string range group span 63 and or in direct alignment to the predetermined string-length tension, an apparent loss of tonal qualities with weaker sound-levels would result. This is simply because in this direct alignment, braces 1 and 2 would reflect the strings 40 saddle nodal points' vibrations of APW within themselves, back and forth and not into the soundboard. Essentially a locked up longitudinal vibrating loop would be created, between the vibrating strings and within the braces 1 and 2, connecting the bridge 29 to neck 37 in direct alignment to the strings 40.

Whilst a direct alignment of braces 1 and 2 would seem to be a desirable arrangement so as to allow for sustain of the vibrating strings 40; the antinodes and nodes of APW that would be generated and occur at points anywhere within the braces at any given time, are largely contained and restricted along their lengths and ends. The antinodes and nodes of a locked up source are of no viable use, or of very little service, for the transmission (passing) of APW into the soundboard 52.

Still referring to FIG. 3, to avoid this vibration loop in the invention, one free end for each (at points-C) of the indirect-bar braces 1 and 2 are located below the bridge saddle 32 either side of and away from the string range group span 63. It is also important that the free ends at points-C of the indirect-bar braces 1 and 2 are positioned a short distance away from the string range group span 63. Indirect-bar braces 1 and 2 do not enter within the string range group span 63 or any where too close, they operate by holding the string range group 40 tensional forces—PST and the strings 40 EE, from the outside of the string range group span 63, not directly, but more so indirectly; hence the naming for the indirect-bar bracing 1 and 2. As may be seen in FIG. 3, indirect-bar braces 1 and 2 are also placed and affixed at an acute angle—generally designated by the reference character "θ", adjacent to but away from the line of the strings and neck, in order that their vibrating reflections do not easily reflect back into the neck 37.

As an added advantage the acute angle θ of the indirect-bar braces 1 and 2 also helps to balance or stabilizes the up and down motion of the soundboard 52, for the movement either bass side or treble side only or both sides together. Other features, advantages and objects of the invention that may be seen in FIG. 3, will be better understood in conjunction with FIG. 4.

Figure 4:
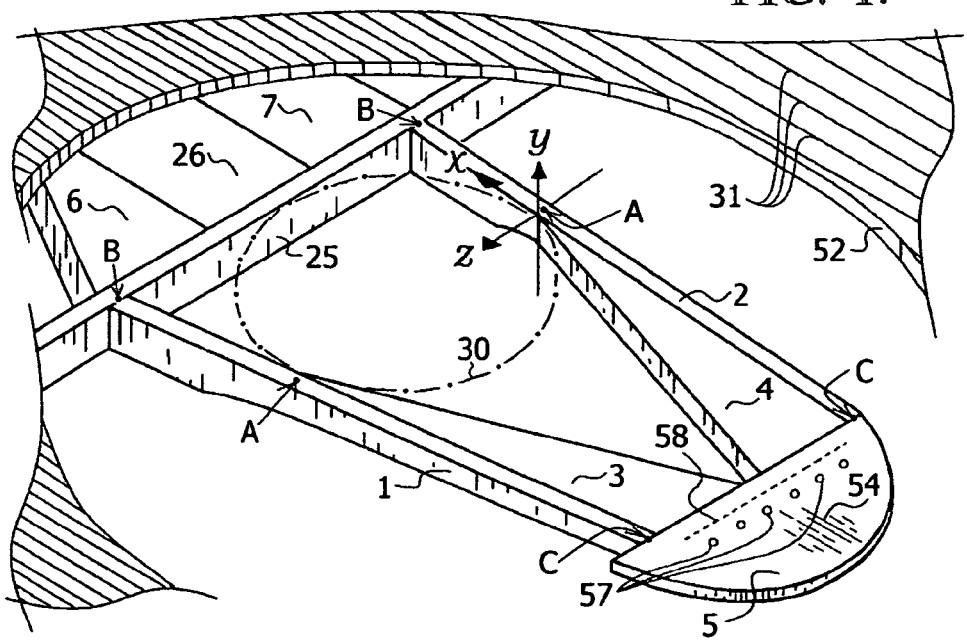
FIG. 4 is an exposed partial perspective view with the soundboard partially removed, and generally shows dimensionality for the main bracing bars and bracing members of FIG. 3, and specifically indicating the three dimensional planes for the perceived acoustic pressure waves within the main bracing bars.

Referring now to FIG. 4, an exposed perspective view with the soundboard 52 partially removed, showing indirect-bar bracing 1 and 2 and parts or members central and critical 545 to the inventions main bracing system structure, with other bracing of the invention omitted in order to simplify. The dot-dash circular line shows where the soundhole 30 would normally be, while the short-dashed straight line outlines 58 shows where the positioning of the saddle 32 would sit in its bridge 29 on top of the soundboard 52. The half circular shaped bracing member 5 interconnects with the indirect-bar bracing 1 and 2 as well as triangular blocks 3 and 4 as may be seen in the underside soundboard 52 perspective view of FIG. 12, and is also referred to herein as a "transmitting-lobe" 5 of which the naming and function of will become apparent further within the detailed description.

Referring back to FIG. 3 and to further address the processing of the second function, the string range group 40 vibrating nodal points of the saddle 32 are next in question.

Triangular blocks 3 and 4 are used to mechanically load the PST and couple the APW, transmitting from the vibrating nodal points of the saddle 32 into the indirect-bar braces 1 and 2. The PST, places a static tensional load line of force, represented by the straight short-dashed lines 61 running from the bridge pin holes 57 through the triangular blocks 3 and 4 to points-A. All load lines of PST 61 from each string 40 are redirected at acute angles—generally designated by the angular reference character "ω", and are concentrated to and due to, the weakest points-A, where triangular blocks 3 and 4 run-out or finish onto the indirect-bar braces 1 and 2.

Generally the points-A in FIG. 3 are essentially mass loaded by the redirected ω static PST 61, and any vibrations transmitted by one or more active strings 40 through the saddle 32 nodal points forming APW then follow the short-dashed lines 61 of the redirected ω PST 61 to points-A. Converging at points-A the APW continue on in the "x" direction, as indicated in FIG. 4, and reflect at equal but opposite angles on all sides of points-A, as indicated by the continuation of the short-dashed lines (towards antinodes 56) seen in FIG. 3, in the planes of "y" and "z", as indicated in FIG. 4.

As may be seen in FIG. 3 between points-A and B antinodes 56 are formed, represented by the corners of the short-dashed lines, before the APW recon verge to nodal points-B. The cross-sectional area between points-A and points-B of each indirect-bar brace are made larger than for the rest of the indirect-bar brace, as may be seen in FIG. 4, so as APWE is not wasted transversely in the area of antinodes 56, the other added advantage is to uphold the integrity of the PST.

A new active transmission nodal point essentially mass loaded by the redirected w PST 61 then exists at the convergence points-A. Essentially an input-output source has been created for the second stage at an acute angle θ, and able to divert APW away from the direct alignment of the string range lengths, whilst upholding the integrity for the PST force of the first stage.

At points-B indirect-bar braces 1 and 2 are firmly fixed to or interlock with a commonly used transverse brace 25 and are further supported by the neck area support blocks 6, 26, 7, 8, 9, and 27), which may be seen in FIG. 4 and in conjunction with FIG. 5, the function 585 of these blocks will be discussed further within the detailed description.

Figure 5:
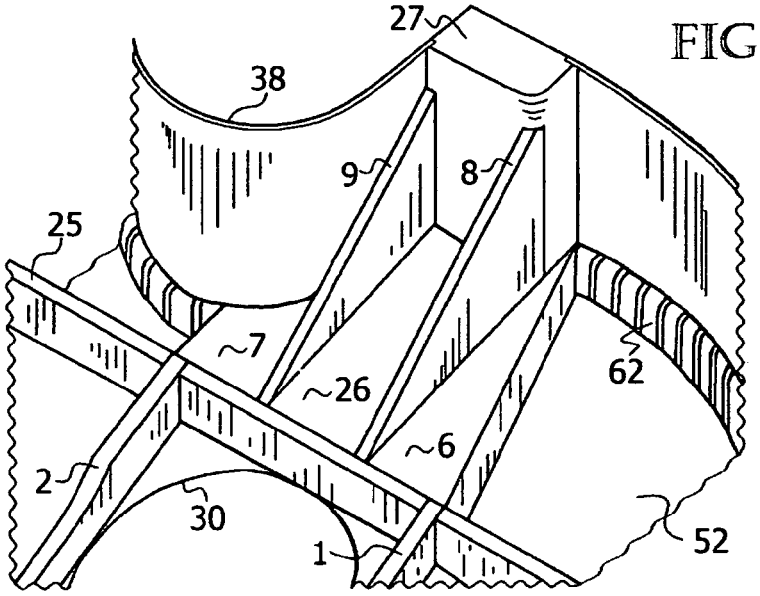
FIG. 5 is an inside partial perspective view of the body with the backboard removed and shows various bracing members, but specifically used to show the blocking up of the underside soundboard area generally under the fingerboard for any one of the embodiments FIGS. 6, 8 and 9.

Referring now to FIG. 5, an inside partial perspective view of the body 49 or 64 with the backboard removed shows the blocking up of the underside soundboard 52 area, generally under the fingerboard 36 not seen, and generally used to support the indirect-bar braces 1 and 2 interlocking with the commonly used transverse brace 25. Block 7 having one curved side adapted to the side wall 38 and one free side, with two other sides forming a right-angle butted up to the transverse brace 25 and to a commonly used fingerboard support block 26. Supporting block 6 has a triangular shape and it too is butted up to the fingerboard block 26 and transverse brace 25. Blocks 7, 26 and 6 are quite thick, matching the height of the transverse brace 25, while the triangular shaped bracing blocks 9 and 8 attached to block 26 and the neck-heel block 27, have relatively thin sides and are used to further prevent vibration of the fingerboard support block 26. The neck-heel block 27 allows for the fixing of the neck 37 heel 56 to the body 49 or 64. The linings 62 are simply used to assist the attachment of the soundboard 52 to the side walls 38.

Firming up of the soundboard 52 area generally under the fingerboard, and more specifically with blocks 6 and 7 used either side of the fingerboard support block 26, is essential to provide a firm mass loading to points-B. Blocks 6 and 7 minimize losses in APWE and facilitate wave reflection, and therefore blocks 6 and 7 are herein referred to as "reflection-blocks". Points-B are then able to provide other nodal points to aid the reflection of APWE back through the timber grain of indirect-bar braces 1 and 2, in the direction of points-B to points-A to points-C.

The input output processing of stage one into stage two has been accomplished to a maximum potential. Points-A along with the strings 40 nodal saddle 32 points and due to their realigned ω PST, are not easily able to reflect acoustic pressure wave energy back into a vibrating string-brace loop configuration, that may had otherwise been the case. Instead all of the said points-A, B and C along with the strings 40 nodal saddle 32 points are diverting the transmitted APWE directly into the following soundboard 52 bracing 615 structure system.

Referring once again to FIGS. 3 and 4, points-C are generally free from the direct PST; hence oncoming reflected APWE is in the form of open antinodes at points-C and are then able to spill into the transmitting-lobe 5. The transmitting-lobe 5 is also able to collect APWE from the strings 40 nodal saddle 32 points being reflected at equal and but also opposite angles to the realigned ω PST, since the strings 40 are not directly supported against the PST in this area under the bridge 29 or 59.

Figure 6:
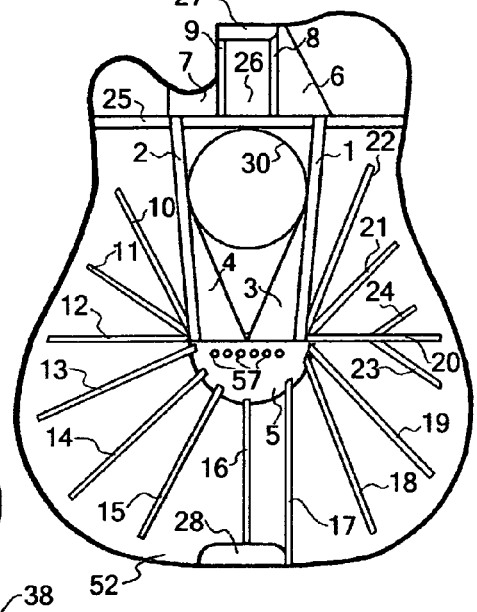
FIG. 6 is a plan view of the underside soundboard having the bracing structure system of a preferred first embodiment of the invention suitable for the guitar example of FIG. 1.

Referring now to FIG. 6, a plan view of the underside soundboard 52 having the bracing structure system of a preferred first embodiment of the invention most suitable for the guitar example 50 of FIG. 1 is shown.

Figure 7:
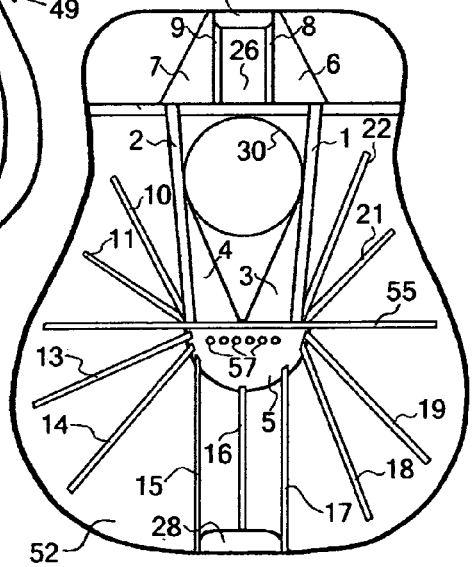
FIG. 7 is a plan view of the underside soundboard having the bracing structure system of a second embodiment of the invention.
Figure 9:
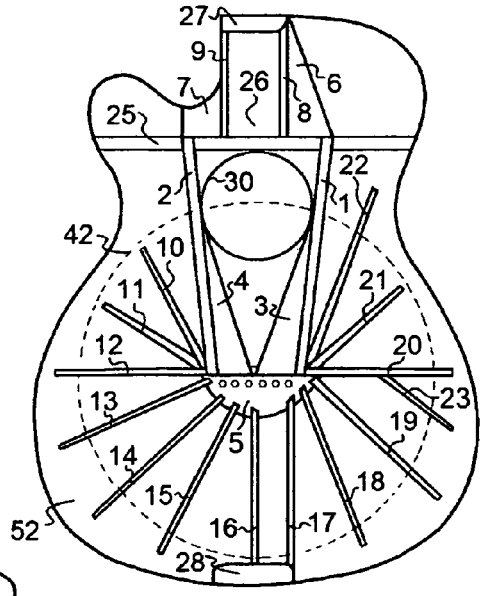
FIG. 9 is a plan view of the underside soundboard having the bracing structure system of a fourth embodiment of the invention.
Figure 8:
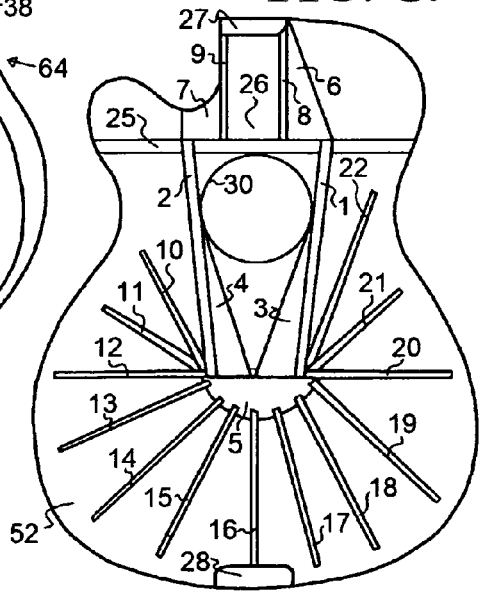
FIG. 8 is a plan view of the underside soundboard having the bracing structure system of a preferred third embodiment of the invention suitable for the guitar example of FIG. 2.

The transmitting-lobe 5 acts as a central hub for the soundboard 52, as may now be understood the function of the transmitting-lobe 5 along with points-C then allows for the APWE to be distributed through finer cross-sectional transmitting-bar braces having the designated numbers of 10, 11, 12, 13, 14, 15, 16, 17, 18, 19, 20, 21, 22, and which are arranged and affixed into a spoke like pattern as may also be seen in FIGS. 7, 8 and 9. Transmitting-bar brace 16 is used to effectively separate or isolate the bass side of the soundboard 52 from the treble side acting as a "divisional-bar" 16—it has a straight tapered length, and or as a "divisional-tieback-bar" 16—with its cross-sectional area then being uniform throughout its length and with its ends fixed to the end-block 28 and transmitting-lobe 5. The functions of the tieback-bar or divisional-tieback-bar 16 are to generally add support, balance, buffer or isolate the two string ranges of bass and treble in a divisional way, for the responding motion of the soundboard 52 between its two sides of low-bass frequencies and high-treble frequencies. Transmitting-bar braces 15 and 17 can also be incorporated as tieback-bars offering other advantages for different reasons, which will become apparent further within the detailed description.

Transmitting-bar braces 10 to 22 function as transmitters of the vibrating transverse acoustic wave energy (TAWE), into the soundboard 52 surface, that's to say that they expel more energy transversely than they do longitudinal within their lengths.

Figure 10:
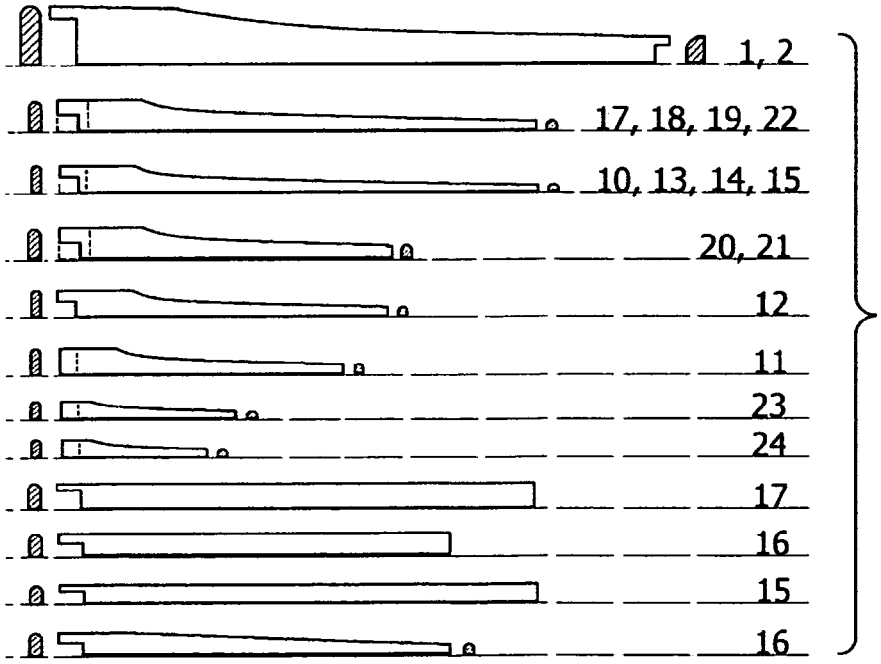
FIG. 10 is a selection of typical profiles or elevated side views and cross-sectional views for the plan view of bracing bars for any one of the embodiments of FIGS. 6, 7, 8 and 9, but relative in comparison only to an individual embodiment.

The TAWE of the transmitting-bar braces 10 to 22 is more so transverse than longitudinal due to their fine or small cross-sectional area compared to their lengths, as may be seen in FIG. 10, and also as in comparison to the main larger structural bracing. The arrangement and sizing of the transmitting-bar braces 10 to 22 are such constructed and positioned to allow for a well-balanced uniform movement of the soundboard 52 areas, occurring on either the bass or treble sides of the soundboard 52 areas independently or with both sides moving in union.

Referring now to FIG. 7 a plan view of the underside soundboard 52 having the bracing structure system of a second embodiment of the invention more suitable for a four 655 stringed bass guitar, which may be similar in shape but larger in body with a longer neck, as compared to guitar example 50 of FIG. 1, and but may also be used for the guitar example 50 of FIG. 1 for various other wanted tonal reasons, is shown. All the designated numbered parts are the same as for FIG. 6 but may differ in location and or size.

Referring now to FIG. 8 a plan view of the underside soundboard 52 having the bracing structure system of a preferred third embodiment of the invention most suitable for the classical guitar example 51 of FIG. 2, is shown. All the designated numbered parts are the same as for FIG. 6 but may differ in location and or size.

Referring now to FIG. 9, a plan view of the underside soundboard 52 having the bracing structure system of a fourth embodiment of the invention most suitable for a small bodied light gauge steel string guitar, having a similar body shape and size as compared to the classical guitar example 51 of FIG. 2, but normally with a thinner neck, is shown. All the designated numbered parts are the same as for FIG. 6 but may differ in location and or size.

In looking at the underside soundboard 52 embodiments of FIGS. 6, 7, 8, and 9, it may be seen that the bracing structure system is split or divided into two nearly identical mirror images, were the bass side of the soundboard 52 is almost identical to the treble side. Triangular block 3 processes the three bass strings while triangular block 4 processes the three treble strings, independently. Besides the triangular blocks 3 and 4 having a mechanical load of ω PST and an APW coupling function as described earlier, they also act as mixing input stages and buffer stages. The mixing action of the triangular blocks 3 and 4 is achieved due to the concentration of all APW following the load lines of ω PST to point-A, as can be seen in FIG. 3. To clarify for the important function of buffering, it needs to be understood that a musical note sounds harmonious when the fundamental frequency is heard along with its first few low level sounding harmonics. With six strings 40 in all, and when one string is set to vibrate by the musicians hand only, then if the other strings are not restrained by a physical mass they will also vibrate to some noticeable degree in sympathy to the surrounding vibration disturbance. These sympathetic vibrations from the other strings, will effectively mask or obscure the original low level sound volume of the harmonics in the content of the musical note sounded. The substantial mass of each triangular block 3 or 4 buffers inactive strings from the surrounding vibrations, thus the processing of clear clean musical sound is achieved.

Due to the functions of the multifunctional triangular blocks 3 and 4: to load, to mix, to buffer, and to divide the string range group 40 they may herein also be referred to using the acronym "LMBD-blocks" 3 and or 4.

The processes of the third function are to enable the uniform motion of the soundboard by alleviating the stress on the soundboard from the PST force. In fact this has been achieved due to the integrity of the first and second functions.

By the said arrangement of the LMBD-blocks 3 and 4 and by the proper sizing and positioning of indirect-bar braces 1 and 2, with points-A to points-B taking up the PST force. More in particular points-A become hinging points for the central area of the bridge 29 or 59 on the soundboard 52.

The structural stiffness between points-A to the bridge 29 or 59 along in part with the substantial mass of the transmitting-lobe 5, eliminates the upward deflection (bulging) of the soundboard 52 behind the bridge 29 or 59. This arrangement also supports and allows the motion of the soundboard 52 at the central bridge 29 or 59 area to vibrate by enlarge only in a perpendicular direction to its surface area. Uniform motion of the soundboard 52 is therefore achieved for stage three.

Figure 11:
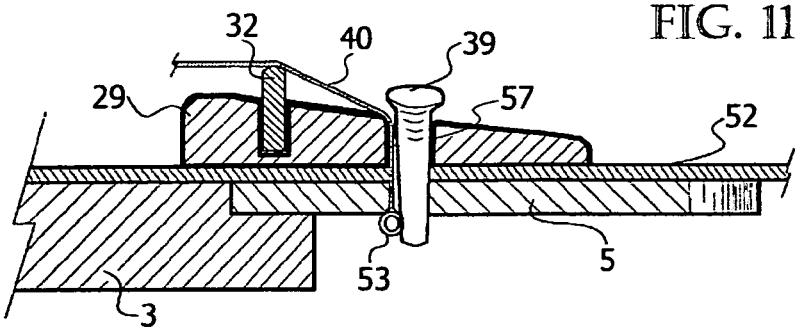
FIG. 11, is a partial cross-sectional view of the bridge and other related parts taken along line 11-11 of FIG. 1

Furthermore the rotational torque component force that's due to each of the very short string 40 lengths, between the anchored ball end(s) 53 of the pegged 39 strings 40 to the contact point(s) of the saddle 32, as may be seen in the partial cross-sectional view of FIG. 11, is stabilized by the mass of the LMBD-blocks 3 and 4. Inward deflection of the soundboard 52 in front of the bridge 29 is therefore also eliminated, supporting the strings 40 EE and enabling the strings 40 nodal saddle 32 points to efficiently take up the transmissions of APWE.

It should thus now be noticed that the perimeter of the soundboard 52 is also alleviated from the deflections that may have been caused otherwise by a PST force.

Sound wavering of the guitars 50 or 51 soundboard 52 from its central bridge 29 or 59 position thus finishes at the perimeter without interference.

Referring now to FIG. 11, is by enlarge a cross-sectional view; of the bridge 29, saddle 32, exposed bridge pin hole 57, soundboard 52 transmitting-lobe 5, and showing one string 40 with its ball end 53 anchored by bridge pin 39, taken along line 11-11 of FIG. 1. Of interest is a partial cross-sectional view of triangular block 3 interlocking with the transmitting-lobe 5, showing the position of its interlocking side relative to the saddle 32 above and the close proximity of this side in alignment with the bridge pin holes 57, as may be seen also in FIG. 12 overlapping the transmitting-lobe 5. An important aspect of the interlocking sides of triangular blocks 3 and 4 with the transmitting-lobe 5 and their positioning in relation to the above saddle, allows for a close direct transmission of APW into triangular blocks 3 and 4 and the transmitting-lobe 5.

Figure 12:
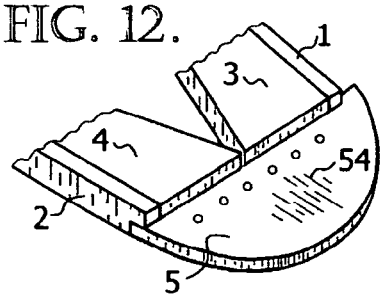
FIG. 12 is an underside soundboard partial perspective view of FIG. 4.

Referring now to FIG. 12, shows an underside soundboard 52 partial perspective view of the LMBD-blocks 3 and 4 adjoining indirect-bar braces 1 and 2 forming a combined side and interlocked with transmitting-lobe 5. The transmitting-lobe 5 is ideally made from a piece of quarter cut hard timber, and should have its annual growth lines 54 or timber grain aligned to the direction of the strings 40, for optimum performance; since generally stated here timber has greater strength along its grain than it does across its grain. By aligning the annual growth lines 54 of the transmitting-lobe 5 to the direction of the strings 40, both the bass and treble flat surface area-sides of the transmitting-lobe 5 centrally divided by the two LMBD-blocks 3 and 4, are able to move (vibrate) more independently to one another. Other advantages for the alignment of the annual growth lines 54 include; further support of the LMBD-blocks 3 and 4 against the PST force; but more importantly allowing for the transmissions of APW coming from points-C and the strings 40 nodal saddle 32 points to have strong supporting pathways, within the transmitting-lobe 5 connecting to the transmitting-bar braces 10 to 22.

With reference now again to FIG. 9 and in conjunction with FIG. 2, to make the best possible use of the available TAWE within the transmitting braces 10 to 22, I will mention herein also that part of the invention though not claimed, is to locate and affix the bridge 59 or 29 onto the soundboard 52 more so central to the extremities of the curved bottom bouts 60, than that found on traditional guitars produced today. By taking a radius from the center of the bridge saddle 32 out to the waist 41 of the body and sweeping out a circular area represented by the dot-dash circular circumference line 42 as may be seen in FIG. 9, should encompass the greater majority of the lower soundboard 52 area, up to the near edge of the end-block 28.

The available acoustic transverse wave energy traveling through the transmitting-bar braces 10 to 22 from the transmitting-lobe 5 towards the perimeter of the soundboard 52 is gradually dissipated as it encounters more and more structural mass. Simply the transverse acoustic wave energy (TAWE) has a lesser effect on the soundboard 52, as it becomes far-reaching. Hence the need for a more centralized bridge 59 or 29 position, allowing for a more even and equal length of the transmitting-bar braces 10 to 22, and thus allows for a more even and equal distribution of the available TAWE throughout the greater majority of the soundboard 52 area 42.

Centralizing the bridge, on guitars commonly produced today would change the string length of the instrument, if the string length is to remain the same, then the entire fixed string length from the nut of the neck to the saddle of the bridge must all move together. This means that the neck will have to join the body at a different fret location, or else the body shape would need to be readjusted. Large body steel stringed guitars produced today normally have a neck with fourteen frets free of the body, while the Spanish classical guitar with its smaller body only having a neck with twelve frets to the body.

To overcome this problem, neck 37 to body 49 or 64 placements; in the invention for the large body 49 steel stringed acoustic guitar example 50 of FIG. 1, the neck 37 is still able to have fourteen frets 43 free of the body 49, by the curving of the appropriate upper bout shoulder 44 of the body 49, as may be seen in FIG. 1. While for the Spanish classical 775 guitar example 51 of FIG. 2, this problem, neck 37 to body 64 placements; is solved in the invention as may be seen in FIG. 2, simply by the neck 37 joining with the body 64 at the thirteenth fret, without changing the shape of the body.

In the invention to allow for a manageable sound-sustain-level for the string range set of six strings 40 and thereby giving a well-balanced response between the strings 40; the following problems are overcome, by using a novel approach as to the positioning of the transmitting-bar braces 10 to 22.

Aforementioned elsewhere herein the mass weight of a lowest-frequency-bass string 40 compared to a highest-frequency-treble string 40 is greatly different, in fact respectively approximately sixteen times greater for both guitar examples 50 and 51 using the six string range groups 40 that are commonly used on other guitars today. With this in mind and the fact that a bass string will vibrate for a longer period than a treble string due to the available energy that's inherent in its mass; the problem of allowing for a manageable period of sound-sustain-level for the string range group of six strings 40, in the invention is overcome by the following novel approach. In the invention to obtain a balanced sound-level of sustain that's manageable throughout the string range group 40 from the soundboard 52, involves structural differences from one side of the soundboard 52 to the other side. Generally the resistance of the soundboard 52 in respect to vibration needs to be greater on the bass side than it is for the treble side, the novel approach that's taken to achieve this, takes into account the following.

A timber soundboard has annual growth lines 31 as may be seen in FIGS. 1, 2, and 4, running parallel or in line with the strings 40. The soundboard on its own is most flexible across the annual growth lines (the grain of the timber). The arrangement of the transmitting-bar braces 10 to 22 takes advantage of this fact and since the soundboard 52 is now essentially free from the PST or substantially alleviated thereof; its response to resistance can only be attributed to the arrangement of the transmitting-bar braces 10 to 22.

A well-balanced soundboard 52 response is achieved by the following arrangement of the transmitting-bar braces 10 to 22.

To prolong the sustain period of sound-levels for the treble range; transmitting-bar braces 10 to 15 are positioned and affixed onto the treble side of the soundboard 52 to point-C and to the circular perimeter of the transmitting-lobe 5; so that the angles they tend to be aligned to, are collectively in total crossing the annual growth lines of the soundboard more so in a perpendicular direction, as may be seen in FIGS. 6, 7, 8, and 9. Braces in this direction with TAWE encounter less resistance from the soundboard; therefore the treble range is sustained for a longer period.

While on the bass side of the soundboard 52 transmitting-bar braces 17 to 22, are collectively in total aligned in a direction more so parallel with the annual growth lines of the soundboard, as may be seen in FIGS. 6, 7, 8, and 9, effectively increasing the stiffness 815 of the transmitting-bar braces 17 to 22 and at the same time increasing the resistance of the soundboard 52 to be vibrated, thereby limiting the sustain period of sound-levels for the bass range.

With reference to FIG. 6 having a soundboard 52 bracing structure system of a preferred first embodiment well suited for the acoustic guitar example 50 of FIG. 1; transmitting-bar brace 20 is aligned perpendicular to the annual growth lines of the timber soundboard 31 and fixed to the bass side of the soundboard 52; TAWE in this transmitting-bar brace 20 due to its alignment is able to vibrate the soundboard 52 vigorously.

On this bass side of the soundboard 52 the bass string(s) producing transverse acoustic 825 wave energy (TAWE) is much more prolonged than it is for the opposite treble side of the soundboard 52, and if left unchecked would over-balance transmitting-bar braces 10 to 15. In order to balance the bass side soundboard 52 area generally around the transmitting-bar brace 20, two smaller braces 23 and 24 are attached to transmitting-bar brace 20 and fixed to the soundboard 52 at an acute angle, in order to stiffen the soundboard 52 and thereby resist oncoming TAWE.

Referring now to FIG. 10, shows typical profiles (elevated side views) and cross-sectional views of the main bracing bars and finer transmitting bars as indicated by the designated numbering thereof, relative in comparison only to the individual soundboard 52 bracing 835 structure system for any one of the embodiments of FIGS. 6, 7, 8 and 9. It is noted here that braces 15,16, and 17 have two profile options and as to which profile is used, depends on which of the embodiments FIG. 6,7, 8 or 9 is referred to herein.

Figure 13:
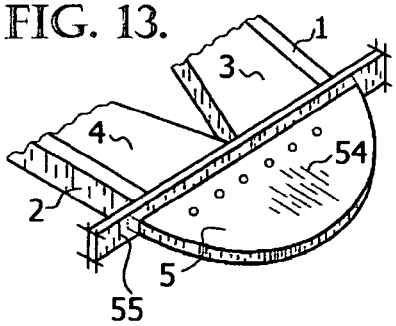
FIG. 13 is an underside soundboard partial perspective view of FIG. 4, showing in particular an alternative bracing member.

Referring once again now to FIG. 7 Being a second embodiment of the invention more suitable for a four stringed acoustic bass guitar, the cross sectional areas of the braces in general are made proportionally larger. Of interest is shown an alternative bracing member 55 replacing transmitting-bar braces 12 and 20, better suited for an acoustic bass guitar. The fitment of brace 55 may be seen in FIG. 13, of which shows brace 55 having an overlapping-joint across the transmitting-lobe 5. Of further interest as may be seen in FIG. 7 and in conjunction with FIG. 10, transmitting-bar braces 15, 16 and 17 have a uniform cross-sectional length and are attached to the transmitting-lobe 5 and end-block 28, and function as tieback-bar braces; since the bass strings of an acoustic bass guitar puts a greater PST force onto the soundboard 52.

Referring once again now to FIG. 6, of interest is the transmitting-bar brace 17 used as a tieback-bar brace 17—having a uniform cross-sectional length, fixed to the bass side of the soundboard 52 with its ends attached to the end-block 28 and transmitting-lobe 5, is used to effectively smooth out the overly long periods of sustain that occurs from the lowest bass strings 40.

Referring once again now to FIG. 8, where it may be seen that transmitting-bar brace 17 is not used as a tieback-bar brace, but instead is used as a typical transmitting-bar brace similar in profile to other transmitting-bar braces of the invention which may be seen and identified in FIG. 10, by the following description: from its larger end having an equal cross-sectional area extending for one sixth part of its total length, and there from its remaining length continuing with a decreasing cross-sectional area likened to a gradual concave exponential curve towards its smaller end. Divisional-bar brace 16 for FIG. 8, has by enlarge from its larger end a straight tapered length, and which may also be seen in FIG. 10. This preferred third embodiment of FIG. 8, of transmitting-bar brace 17 and divisional-bar brace 16 described above is well suited to the classical nylon stringed guitar example 51 of FIG. 2, and is generally due to a lighter PST load on to the soundboard 52 of the body 64.

While the foregoing descriptive analysis of the preferred and alternative embodiments has been specifically related to the acoustic guitar examples given, it may also be understood from the explained functionality of the individual bracing members or by the combination of bracing members of the embodiments, the wider application therefore possible with the soundboards of other acoustic musical stringed instruments.

The explained functionality of the individual bracing members within the bracing structure system of the embodiments, would also suggest other possible alterations, changes or modifications that could be made without departing from the spirit and scope of the invention.

The claims defining the invention are as follows:

1. An acoustic musical stringed instrument comprising:

a hollow body;

a neck extending from the hollow body and anchoring devices at an end of the neck;

a soundboard with one or more soundholes, the soundboard being an integrated part of the hollow body;

a bridge with an embedded bridge saddle attached to the soundboard;

a plurality of strings anchored to the bridge saddle, the strings ranging successively from bass strings of low frequency to treble strings of high frequency, the strings extending over and contacting the bridge saddle, the strings continuing longitudinally to the anchoring devices at the end of the neck and having a string range division with a number of the bass strings grouped from one end across a section of the bridge saddle as a bass string range side and with a number of the treble strings grouped across the remaining section of the bridge saddle as a treble string range side, the bass and treble string range sides being acoustically coupled through the bridge saddle into the soundboard and respectively producing a bass sounding side to one portion of the soundboard and a treble sounding side to another portion of the soundboard; and a soundboard bracing structure including two blocks fixed to the underside of the soundboard to support the soundboard and the bridge saddle, each of the blocks having one of its sides positioned in alignment to and directly below the bridge saddle and another of its sides fixed and butted up to one of two longitudinal bar braces each positioned with one of their ends located below and either side of the bridge saddle and extending indirectly at an acute angle away from the line of the outermost strings, wherein the instrument has at least one of the soundholes under the strings, extending either side of this soundhole, with both other ends interconnected to a common transverse brace.

2. An acoustic musical stringed instrument as claimed in claim 1, wherein the soundboard bracing structure further includes reflection blocks adjoining the side of the transverse brace opposite to that side which is connected to the longitudinal bar braces and butted up to a fingerboard support block.

3. An acoustic musical stringed instrument as claimed in claim 2, wherein the soundboard bracing structure further includes bracing blocks fixed between the fingerboard support block and a neck heel block.

4. An acoustic musical stringed instrument as claimed in claim 1, wherein the soundboard bracing structure further includes a bracing member connected to the blocks fixed to the underside of the soundboard and to the longitudinal bar braces, with a flat face of the bracing member fixed to the underside of the soundboard.

5. An acoustic musical stringed instrument as claimed in claim 4, wherein the bracing member is half circular in shape and is fixed centrally to a combined side formed by the sides of the blocks fixed to the underside of the soundboard that are positioned in alignment to and directly below the bridge saddle and by the ends of the longitudinal bar braces located below and either side of the bridge saddle.

6. An acoustic musical stringed instrument as claimed in claim 4, wherein a plurality of transmitting-bar braces extend from the bracing member in a spoke-like pattern.

7. An acoustic musical stringed instrument as claimed in claims 4, wherein a transmitting-bar brace extends from a point on the bracing member between the bass string range and the treble string range to an end-block.

8. An acoustic musical stringed instrument as claimed in any one of claims 4, wherein a transmitting-bar brace extends from a point on the bracing member approximately in line with the bass string of lowest frequency to an end-block.

9. An acoustic musical stringed instrument as claimed in any one of claims 1, wherein the acoustical musical stringed instrument is a guitar.

10. An acoustic musical stringed instrument as claimed in claim 9, wherein the guitar is a steel stringed acoustic guitar.

11. An acoustic musical stringed instrument as claimed in claim 9, wherein the guitar is a classical nylon or gut stringed acoustic guitar.

* * * * *